US007441678B2

(12) United States Patent
Ford et al.

(10) Patent No.: US 7,441,678 B2
(45) Date of Patent: Oct. 28, 2008

(54) PAPER TIE HANGER

(75) Inventors: Jonathan Ford, Bensalem, PA (US); Allan L. Ford, Bensalem, PA (US)

(73) Assignee: Reborn Products, Co., Inc., Bensalem, PA (US)

( * ) Notice: Subject to any disclaimer, the term of this patent is extended or adjusted under 35 U.S.C. 154(b) by 0 days.

(21) Appl. No.: 11/687,295

(22) Filed: Mar. 16, 2007

(65) Prior Publication Data

US 2008/0223885 A1 Sep. 18, 2008

(51) Int. Cl.
*A41D 27/22* (2006.01)

(52) U.S. Cl. ..... 223/87; 223/85; 223/DIG. 1; 206/292; 206/297; 206/299

(58) Field of Classification Search ..... 223/85, 223/87, DIG. 1; 206/278, 292, 297, 299, 206/458, 806

See application file for complete search history.

(56) References Cited

U.S. PATENT DOCUMENTS

| | | | | | |
|---|---|---|---|---|---|
| 2,320,018 | A * | 5/1943 | Ullman | 206/297 |
| 2,855,649 | A * | 10/1958 | Kanter | 223/87 |
| 2,910,214 | A * | 10/1959 | Gouner | 223/87 |
| 2,941,703 | A * | 6/1960 | Abramowitz | 223/87 |
| 3,032,242 | A * | 5/1962 | Roberts | 223/87 |
| 3,069,009 | A * | 12/1962 | Hoeflich | 223/87 |
| D202,316 | S | 9/1965 | Pehr | |
| 3,329,386 | A * | 7/1967 | Rosen | 223/87 |
| 3,370,765 | A * | 2/1968 | Jossem | 223/87 |
| 3,456,853 | A | 7/1969 | Hodge | |
| 4,190,151 | A * | 2/1980 | Russell | 223/87 |
| 4,646,951 | A | 3/1987 | Gasser | |
| 5,084,916 | A | 2/1992 | Austin | |
| D342,613 | S | 12/1993 | Ackerman | |
| 5,469,959 | A * | 11/1995 | Gummer | 223/87 |
| 5,505,351 | A | 4/1996 | Najarian | |
| 5,953,755 | A | 9/1999 | Barylski | |
| 6,032,793 | A | 3/2000 | Oakley | |
| 6,237,762 | B1 * | 5/2001 | Faircloth | 206/299 |
| 6,981,588 | B2 * | 1/2006 | Kimura | 206/297 |
| 2004/0112772 | A1 * | 6/2004 | Kimura | 206/297 |
| 2007/0045130 | A1 * | 3/2007 | Kim | 206/806 |
| 2007/0045131 | A1 * | 3/2007 | Kim | 206/806 |
| 2007/0045136 | A1 * | 3/2007 | Kim | 206/806 |

* cited by examiner

*Primary Examiner*—Gary L. Welch
*Assistant Examiner*—Nathan E Durham
(74) *Attorney, Agent, or Firm*—Caesar, Rivise, Bernstein, Cohen & Pokotilow, Ltd.

(57) ABSTRACT

A hanger for displaying a necktie includes a main panel made from a flexible sheet material. The panel includes a front portion and a rear portion. The top edge of the front portion is disposed against a fold portion and the two side edges of the front portion each have a tab extending adjacent to the fold portion, the tabs being parallel to the fold portion. The side edges each have a flap. The rear portion includes a top edge, two side edges and a bottom edge. The top edge of the rear portion is disposed against the fold portion. The two side edges of the rear portion each have a tab extending therefrom at a point opposite to the fold portion where the tabs are generally parallel to the fold portion. The fold portion has an aperture for receipt of a hook.

1 Claim, 4 Drawing Sheets

PAPER TIE HANGER

BACKGROUND OF THE INVENTION

This invention relates to display devices and, more particularly to a hanger device for supporting neckties for display on a rack.

In department stores, menswear shops and the like, neckties are most often either displayed by laying the neckties out flat or by hanging the neckties on various types of stands, using, for example, plastic necktie hangers. Neckties that are laid out flat for display need near constant attention by store employees to keep the neckties orderly and in an attractive condition to facilitate sale. Neckties that are displayed on stands with the various necktie hangers on the market may also be easily removed from the hanger, which, again, creates display difficulties and maintenance issues. Here, neckties may be easily pulled from the hanger, requiring store employees to properly re-hang the neckties on the hangers.

Some neckties are hung and displayed in a knotted condition. However, neckties displayed in this manner require a fairly complicated procedure to hang the neckties on hangers. Additionally, unsightly wrinkling of the neckties may occur. It would be highly desirable to provide an inexpensive necktie hanger that keeps neckties in a neat and uniform folded position, even with substantial customer contact such that attention required by store employees is minimized.

Various necktie hangers are known which are intended for hanging neckties for display. For example, U.S. Pat. No. 4,646,951 (Gasser) is directed to a necktie display holder and blank which is used to display an individual necktie in a knotted condition. Two arms that protrude laterally from a front part are folded in toward each other and connected to each other to hold the necktie fast. The front part has a triangular cutout so the necktie and knot are visible. The two arms are provided with complementary incisions so that they can be interconnected to hold the display together.

U.S. Pat. No. 5,953,755 (Barylski) is directed to a necktie holder that is made of two pieces, including a one-piece sleeve and a one-piece retainer. The one piece sleeve is frustoconical with a large diameter top and a smaller diameter bottom. A slot in the sleeve extends from the top to the bottom for receiving both ends of the necktie. A one-piece retainer, having an H-shaped cross section is placed in the slot to hold the necktie therein.

U.S. Pat. No. 5,505,351 (Najarian) is directed to a hanger for a pre-tied necktie assembly. The assembly includes a necktie, a knot support to form a necktie knot, a clip for removably mounting the necktie assembly onto the neckband of a shirt collar, and a positioning post extending through the necktie knot. The hanger includes an upper hook portion, a central body portion, and a lower stem portion. The stem portion has an opening therethrough to fit over the post of the necktie assembly whereby a retaining nut, when placed over the post with the stem portion positioned between the necktie and the nut, will securely maintain the necktie assembly on the hanger. Removal of the necktie assembly from the hanger is achieved by severing the stem portion from the body portion of the hanger.

U.S. Pat. Nos. Des. 202,316 (Pehr) and Des. 342,613 (Ackerman) are necktie hangers, made from sheet material, that hold neckties in a folded condition.

U.S. Pat. No. 5,084,916 (Austin) is directed to a necktie assembly for use as a pre-tied necktie in which a reversible tie piece is held in place between interlocking front and rear tie-knot shells by a slide bar and a bar lock. The entire assembly is held around a user's neck by an adjustable band and a bracket provides a raised or lowered affect to the tie's knot.

U.S. Pat. No. 3,456,853 (Hodge) is directed to a display device for a pre-tied necktie that is made from a flexible sheet material that has an upper portion forming a hook and a main portion, wider than the hook, and depending from the hook. The main portion has two pointed tabs that simulate the tabs of a collar. A third tab that depends from the main portion between the simulated collar tabs is adapted to be flexed rearward and to receive through an aperture the holding tab of the holder on which the necktie is pre-tied. The holding tab engages the inside of a collar band to secure the holder and its necktie to the band. Therefore, the necktie holder is connected partly within the knot of the tie and partly behind the display device. The tie is displayed in a manner simulating actual use.

U.S. Pat. No. 3,370,765 (Jossem) is directed to a support for suspending a combination tie and handkerchief set for display. The hanger is a cardboard blank formed in three sections, an end of which is folded between the other two sections. The end section has a straight upper edge, and a tongue at its outer end, which fits into a downwardly extending slot at the junction of the other sections to hold the straight edge of the first section horizontal. Another tongue on the other end section engages in a slot in the first section to hold the blank folded. A necktie and a handkerchief may be suspended over the upper edge of the first section. Hooks are formed at the upper edges of the other sections, which register when folded, for hanging the tie and handkerchief from a display rack.

Other patents are directed to hangers for garments other than neckties. For example, U.S. Pat. No. 3,329,386 (Rosen) is directed to a hanger device for supporting hosiery. A front panel has an upwardly extending hanger portion for releasable attachment to a companion support, and a rear panel composed of two releasably interlocked flaps extend from opposite edges of the front panel. The upper edge of the rear panel, formed by the interlocking flaps, supports hosiery so that the hosiery surrounds and depends from the rear panel. The hosiery depends from the rear panel so that a portion of the hosiery is below the front panel and thereby exposed to the eye of the customer.

Finally, U.S. Pat. No. 6,032,793 (Oakley) is directed to a package for hosiery that is a card having a body and a header adjacent to the body. The body is sized and shaped to receive the hosiery thereabout such that, when the hosiery is mounted on the body, the article conceals the body, but not the header.

All references cited herein are incorporated herein by reference in their entireties.

BRIEF SUMMARY OF THE INVENTION

A hanger for displaying a necktie is provided which includes a main panel made from a flexible sheet material. The main panel includes a front portion and a rear portion. The front portion includes a top edge, two side edges, and a bottom edge. The top edge of the front portion is disposed against a fold portion and the two side edges of the front portion each have a tab extending therefrom adjacent to the fold portion. The tabs are generally parallel to the fold portion. The two side edges each have a flap extending therefrom. The rear portion includes a top edge, two side edges and a bottom edge. The top edge of the rear portion is disposed against the fold portion. The two side edges of the rear portion each have a tab extending therefrom at a point opposite to the fold portion where the tabs are generally parallel to the fold portion. The fold portion has an aperture. A hook is disposed in the aperture in the fold portion to facilitate hanging the hanger.

Preferably, the fold portion is a panel separated by two parallel fold lines. The main panel is preferably made from a paper product.

Also provided is a hanger and necktie display unit for display on a retail rack. The display unit includes a hanger as provided above. A necktie having two ends and folded generally in half to form a first fold line is provided and is disposed on the back side of the front portion. The tabs of the front portion are folded over and are attached to each other to secure the necktie to the back side of the front portion. The folded necktie is disposed on the back side of the rear portion and has the tabs of the rear portion folded over and attached to each other to secure the necktie to the back side of the rear portion. The main panel, in a folded condition, is folded at the fold portion, wherein the front portion and the rear portion are face to face with one another and the folded necktie is folded in half to provide a necktie that is folded in quarters. Finally, the flaps are secured to one another.

A method for hanging a necktie on a hanger for display is also provided which includes the step of providing a main panel made from a flexible sheet material having a front portion, a rear portion, a fold portion, a front side and a back side. The front portion includes a top edge, two side edges, and a bottom edge. The top edge of the front portion is disposed against the fold portion. The two side edges of the front portion each have a tab extending therefrom adjacent to the fold portion. The tabs are generally parallel to the fold portion. The two side edges each have a flap extending therefrom. The rear portion includes a top edge, two side edges and a bottom edge. The top edge of the rear portion is disposed against the fold portion. The two side edges of the rear portion each have a tab extending therefrom at a point adjacent to the fold portion, where the tabs are generally parallel to the fold portion. The fold portion has an aperture.

The method continues with the steps of folding a necktie having two ends generally in half, thereby forming a first fold line, placing the folded necktie on the back side of the front portion at approximately the midway point of the folded necktie, folding the tabs of the front portion over the folded necktie and attaching the tabs together to each other to secure the necktie to the back side of the front portion, folding the tabs of the rear portion over the folded necktie and attaching the tabs together to each other to secure the necktie to the back side of the front portion, and folding the main panel at the fold portion such that the front portion and the rear portion are face to face with one another and the folded necktie is folded in half to provide a necktie that is folded in quarters. Finally, the method includes the steps of securing the flaps to each other and installing a hook in the aperture in the fold portion to facilitate hanging the hanger.

BRIEF DESCRIPTION OF SEVERAL VIEWS OF THE DRAWINGS

The invention will be described in conjunction with the following drawings in which like reference numerals designate like elements throughout the several views and wherein.

DETAILED DESCRIPTION OF THE INVENTION

The invention will be illustrated in more detail with reference to the following embodiments, but it should be understood that the present invention is not deemed to be limited thereto.

Figure 1:
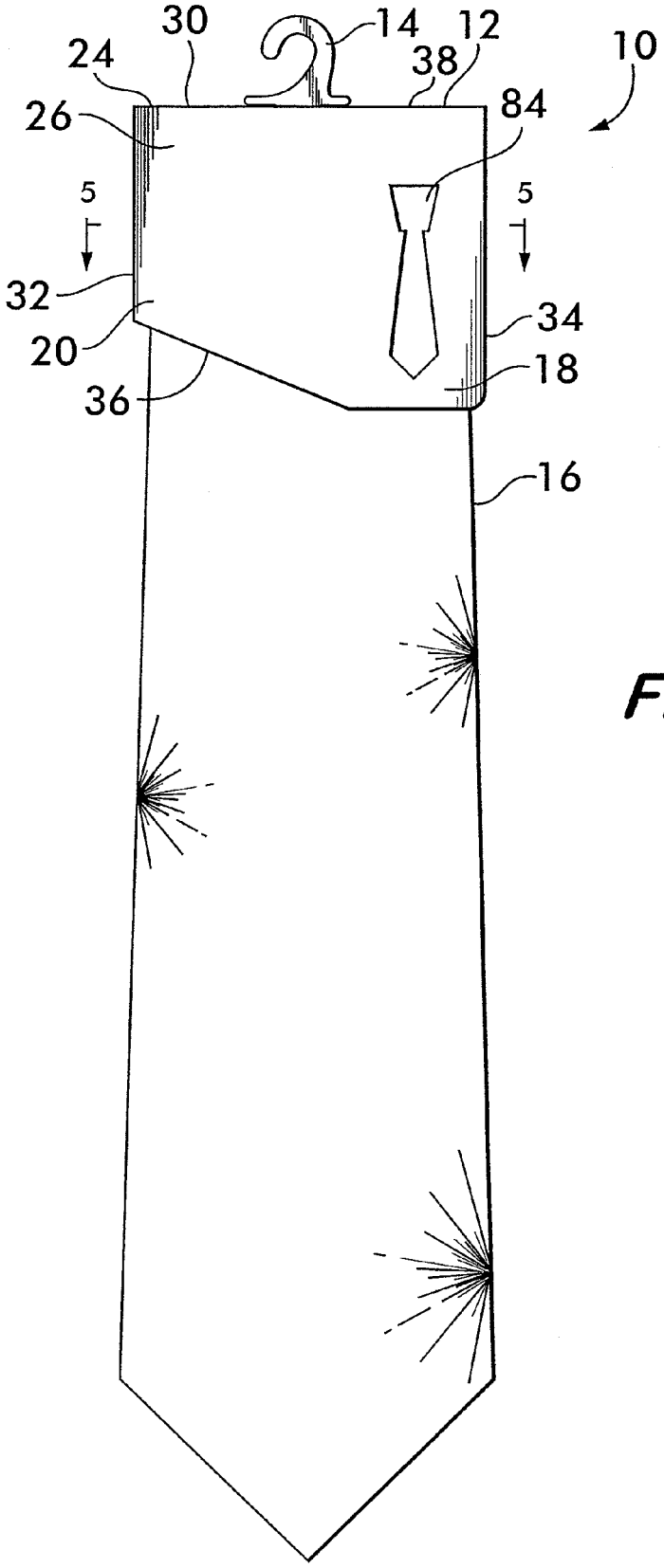
FIG. 1 is front view of a necktie hanger having a hook and necktie attached thereto in accordance with a first preferred embodiment of the present invention.

Referring now to the drawings, wherein like reference numbers refer to like elements throughout the several views, there is shown in FIG. 1, a hanger and necktie display unit 10 for displaying neckties on a retail rack in accordance with a first preferred embodiment of the present invention. The hanger and necktie display unit 10 includes a hanger 12 having a hook 14 and a necktie 16.

Figure 2:
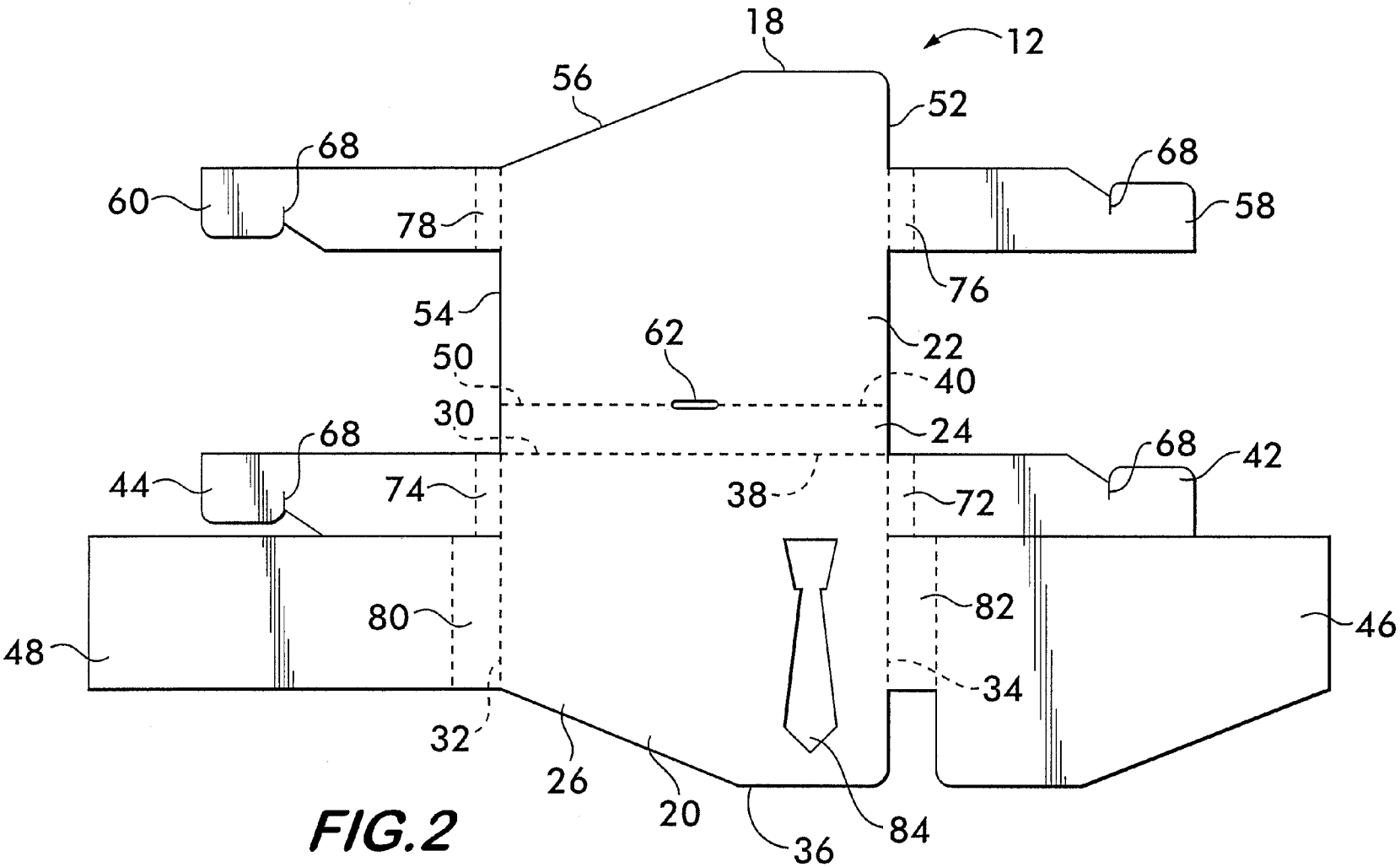
FIG. 2 is a plan view of the back side of the necktie hanger of FIG. 1, shown in an unfolded condition.
Figure 3:
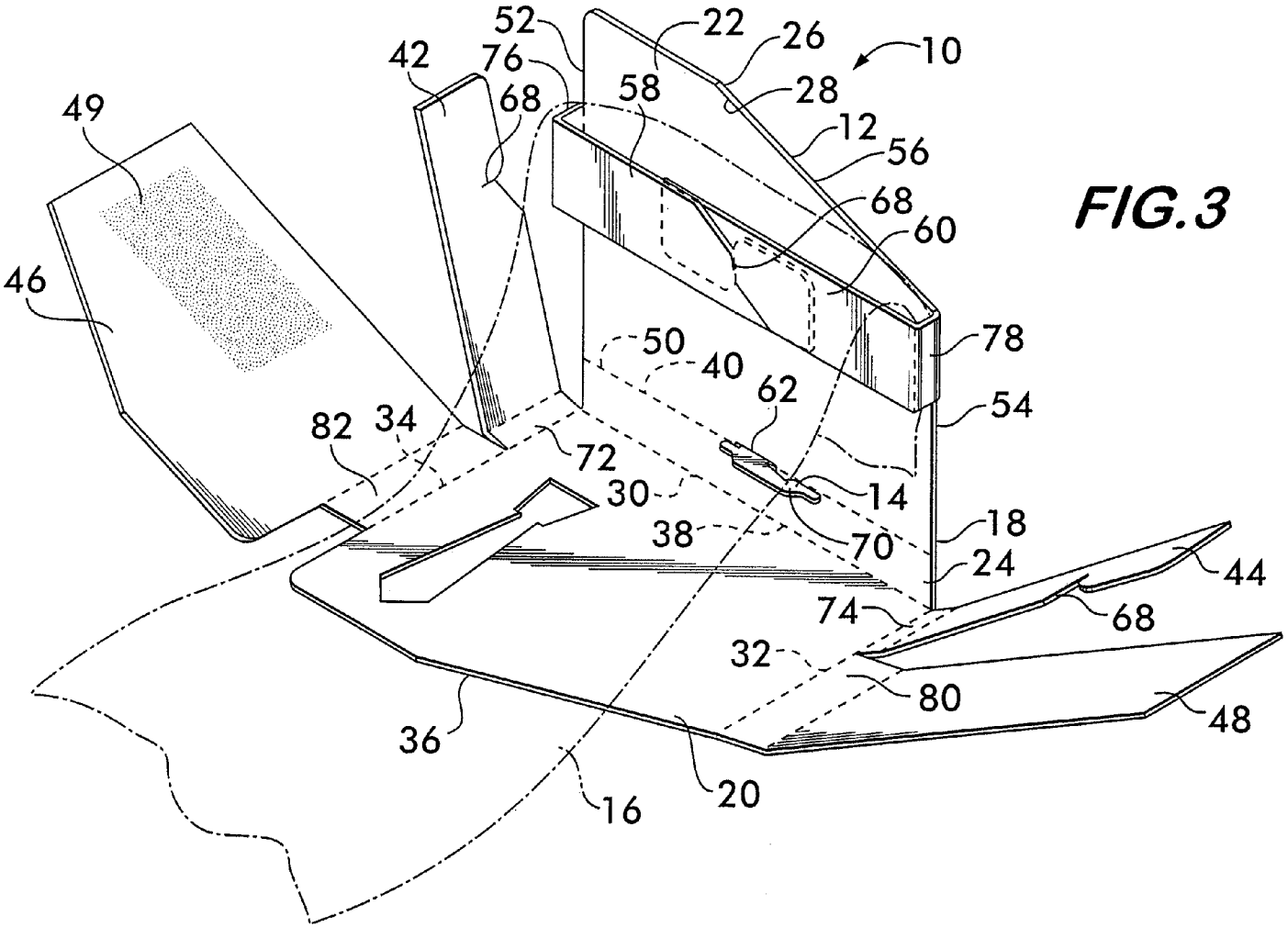
FIG. 3 is an isometric view of the necktie hanger of FIG. 2, shown in a partially folded condition with a portion of a necktie shown in phantom lines.
Figure 4:
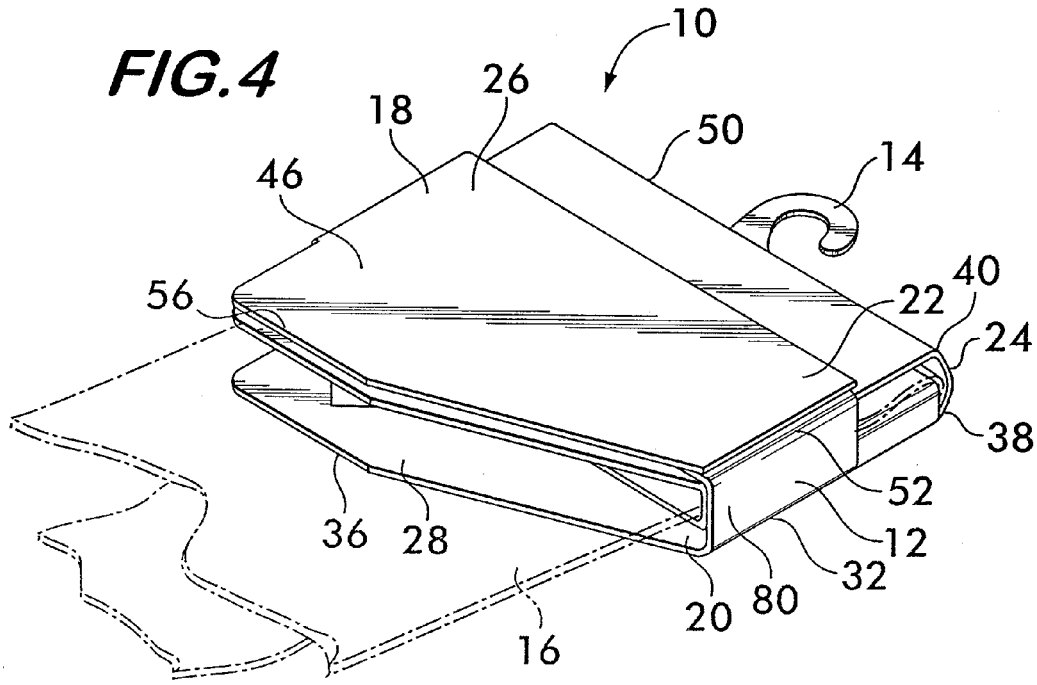
FIG. 4 is an isometric view of the necktie hanger, including a hook, and portion of a necktie shown in phantom lines in accordance with that of FIG. 1.
Figure 5:
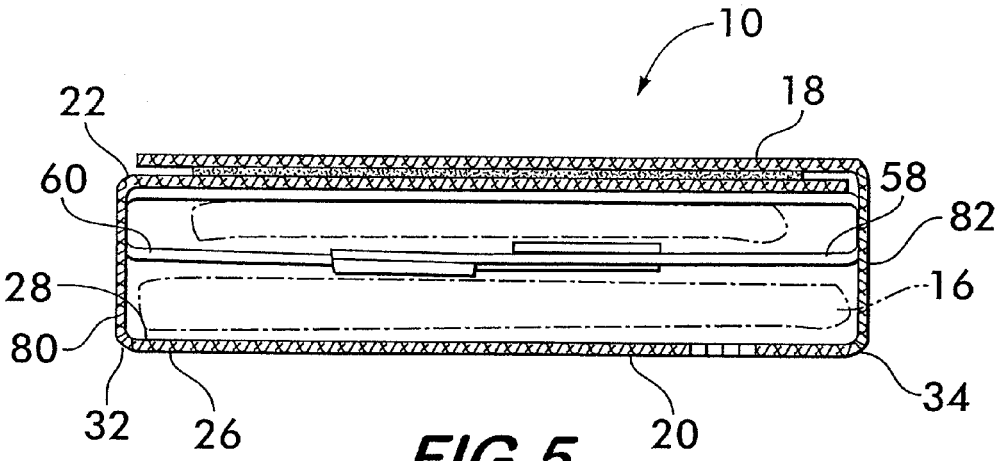
FIG. 5 is a cross-sectional view of the necktie hanger and necktie (shown in phantom lines) of FIG. 1, taken substantially along lines 5-5 of FIG. 1.

As shown in FIGS. 2 through 5 in various configurations, the hanger 12 includes a main panel 18 constructed from a flexible sheet material that includes a front portion 20, a rear portion 22, a fold portion 24, a front side 26 and a back side 28. As seen in FIG. 2, the main panel 18 is depicted in a state prior to folding such that the front portion 20 and rear portion 22 are seen in the same two-dimensional view.

The front portion 20 includes a top edge 30, two side edges 32, 34, and a bottom edge 36. The top edge 30 of the front portion 20 is disposed against the fold portion 24, preferably at a first fold line 38. The two side edges 32, 34 of the front portion 20 each have a tab 42, 44 extending therefrom adjacent to the first fold line 38, the tabs 42, 44 being generally parallel to the fold portion 24. The two side edges each also have a flap 46, 48 extending from the front portion 20.

The rear portion 22 has a top edge 50, two side edges 52, 54 and a bottom edge 56. The top edge 50 of the rear portion 22 is disposed against the fold portion 24, preferably at a second fold line 40. The two side edges 52, 54 of the rear portion 22 each have a tab 58, 60 extending therefrom at a point adjacent to the fold portion 24. The tabs 58, 60 are generally parallel to the fold portion 24.

The fold portion 24 has an aperture 62 to receive a hook 14. The hook 14 is used for hanging the hanger and necktie display unit 10 to facilitate display and purchase by a customer.

As can be seen in FIGS. 1 and 3 through 5, the hanger 12, hook 14 and necktie 16 are assembled into the hanger and necktie display unit 10 in a certain fashion. The necktie 16 is first folded approximately in half such that its ends are somewhat close to one another. For purposes of the present invention, the term "half" is intended to be very broadly construed to include nearly any folded configuration of a necktie that would allow the hanger 12 to function in its intended manner. The folded necktie 16 is placed on a hanger 12 in an entirely unfolded condition, as shown in FIG. 2. While the hanger 12 is in the unfolded condition, tabs 42, 44 of the front portion 20 are secured to one another and tabs 58, 60 of the rear portion 22 are secured to one another using a fastening means such as slits 68, an adhesive (not shown), or other known fastening means. It is noted that the tabs 42, 44 of the front portion 20 are located adjacent to the fold portion 24 while tabs 58, 60 of the rear portion are located at a position away from the fold portion 24 such that, when the hanger is folded, the two sets of tabs 42, 44 and 58, 60 do not interfere with one another.

The main panel 18 is now folded over at the fold portion 24 such that the back side 28 at the front portion 20 is facing the back side 28 at the rear portion 22. Therefore, the necktie 16 is now folded approximately in half twice; first, prior to assembly with the hanger 12 and second, after the securing of the once folded necktie 16 onto the hanger 12 with tabs 42, 44, 58, 60. Flaps 46, 48 are then fastened to one another with, for example, an adhesive 49. As a result, once the necktie 16 is installed on the hanger 12, it cannot easily be pulled free of the hanger 12 without destroying the hanger 12.

The hanger 12 may be made from any flexible, creasable, sheet material such as paper, thin plastic or the like. However, preferably, the hanger 12 made from a paper product for cost considerations.

The hook 14 disposed in the aperture 62 preferably fastens with an arm 70 such that the hook is not easily removed from the hanger 12. Again, any suitable hook that could be attached to paper, would be adequate, for example, a hook attached to the hanger 12 by an adhesive.

Preferably, the fold portion 24 is a short planar section bounded by the two fold lines 38 and 40. This is to accommodate the thickness of four folds of the necktie. Similarly, at the point where each of the tabs folds, short planar sections a72, 74, 76, 79 are provided for the same reason. Likewise, short planar sections 80, 82 are provided adjacent to the flaps 46, 48 for the same reason.

Finally, a cutout 84 in the front portion 20 of the main panel 18 may be provided to view the necktie 16 below.

While the invention has been described in detail and with reference to specific examples thereof, it will be apparent to one skilled in the art that various changes and modifications can be made therein without departing from the spirit and scope thereof.

What is claimed is:

1. A method for hanging a necktie on a hanger for display comprising the steps of:

(a) providing a main panel made from a flexible sheet material comprising a front portion, a rear portion, a fold portion, a front side and a back side;

(i) the front portion comprising a top edge, two side edges, and a bottom edge, the top edge of the front portion disposed against the fold portion, and the two side edges of the front portion each having a tab extending therefrom adjacent to the fold portion, said tabs being generally parallel to the fold portion, the two side edges each having a flap extending therefrom;

(ii) the rear portion comprising a top edge, two side edges and a bottom edge, the top edge of the rear portion disposed against the fold portion, the two side edges of the rear portion each having a tab extending therefrom opposite to the fold portion, said tabs being generally parallel to the fold portion;

(iii) the fold portion having an aperture;

(b) folding a necktie having two ends generally in half, thereby forming a first fold line;

(c) placing the folded necktie on the back side of the front portion at approximately the midway point of the folded necktie;

(d) folding the tabs of the front portion over the folded necktie and attaching the tabs together to each other to secure the necktie to the back side of the front portion;

(e) folding the tabs of the rear portion over the folded necktie and attaching the tabs together to each other to secure the necktie to the back side of the front portion;

(f) folding the main panel at the fold portion such that the front portion and the rear portion are face to face with one another and the folded necktie is folded in half to provide a necktie that is folded approximately in quarters;

(g) securing the flaps to each other; and (h) installing a hook in the aperture in the fold portion to facilitate hanging the hanger.

* * * * *